US006722517B1

(12) United States Patent
Steeber et al.

(10) Patent No.: US 6,722,517 B1
(45) Date of Patent: Apr. 20, 2004

(54) RESEALABLE CONTAINER CLOSURE

(76) Inventors: Donald Edgar Steeber, 4609 Hadensville Farms La., Mineral, VA (US) 23117; Allen Frank Steeber, 12565 Auburn Mill Rd., Glen Allen, VA (US) 23059

( * ) Notice: Subject to any disclaimer, the term of this patent is extended or adjusted under 35 U.S.C. 154(b) by 176 days.

(21) Appl. No.: 10/002,532

(22) Filed: Nov. 16, 2001

(51) Int. Cl.[7] ..... B65D 45/00
(52) U.S. Cl. ..... 220/251; 220/315; 292/257
(58) Field of Search ..... 220/251, 315, 220/906, 247, 250, 243; 292/257, 256.5

(56) References Cited

U.S. PATENT DOCUMENTS 4,410,102 A * 10/1983 Lutzker ..... 220/323
5,186,370 A * 2/1993 Ricketts ..... 222/545
6,053,347 A * 4/2000 Fullin ..... 220/251
6,478,179 B1 * 11/2002 Alexander ..... 220/325

* cited by examiner

*Primary Examiner*—Robin A. Hylton

(57) ABSTRACT

A container closure device comprising an engagement portion joined to but separated from a base to define a gap capable of engaging the peripheral lip or top ridge of a container and including a radially compressible spacer in the gap, a vertically movable cap or plate including a pliant sealing surface on a first side thereof located between the base and the engagement portion and a cam mechanism engaging a second surface of the cap so as to permit driving the cap and its associated pliant sealing surface against the top ridge of the container with which the gap has been engaged.

10 Claims, 5 Drawing Sheets

RESEALABLE CONTAINER CLOSURE

FIELD OF THE INVENTION

The present invention relates to closure devices for containers and more particularly to container closure devices for resealing an opened container and even more particularly to such a device for resealing a previously opened carbonated beverage, food, paint or other suitable container.

BACKGROUND OF THE INVENTION

A great deal of effort has been expended to design and produce a satisfactory closure for resealing, for example, partially consumed soft drink and beer containers. Such efforts have resulted in the production of a large number of variations of such devices, but none has reached very large market penetration.

The shortcomings of the prior art devices are numerous and varied. Many such prior art devices are large, i.e. bulky, and unwieldy, i.e. hard to operate, others because of their design cannot be easily cleaned after use, and yet others such as that described in U.S. Pat. No. 3,982,656 require that a portion of the resealing device actually be inserted into the container to obtain satisfactory sealing, a generally unacceptable requirement since it poses the significant risk of contaminating the container contents through the introduction of foreign matter.

Thus, the need for a satisfactory device capable of resealing a previously opened container such as a soft drink can remains, as does the demand for such a product. Additionally, such a device that could be manufactured in varying sizes for purposes of sealing other reusable containers such as paint cans and the like would be similarly useful and desirable.

OBJECT OF THE INVENTION

It is therefore an object of the present invention to provide a container resealing device suitable for use on a variety of reusable containers such as beverage cans that is easy to use, compact and provides for the ability to be cleaned after one or more uses.

SUMMARY OF THE INVENTION

According to the present invention, there is provided a container resealing device comprising a generally semicircular engagement portion joined to but separated from a circular base by a preferably removable spacer to provide a gap capable of engaging the peripheral lip of a container, a vertically movable circular cap including a pliant sealing surface on a first side thereof located between the circular base and the engagement portion and a cam mechanism engaging a second surface of the circular cap so as to permit driving the circular cap against the top of a container with which the gap has been engaged along the peripheral container lip.

According to various preferred embodiments of the present invention, the cam mechanism can incorporate a means for providing a variety of cam settings to adapt to a variety of container configurations, the spacer is a round, axially compressible and expandable spring to permit easy removal thereof for disassembly of the device of the present invention for cleaning and the pliant sealing surface may cover the entire surface of the circular cap or merely comprise a portion thereof adequate to provide a fluid tight seal against a portion of a resealed container.

DETAILED DESCRIPTION

Figure 2:
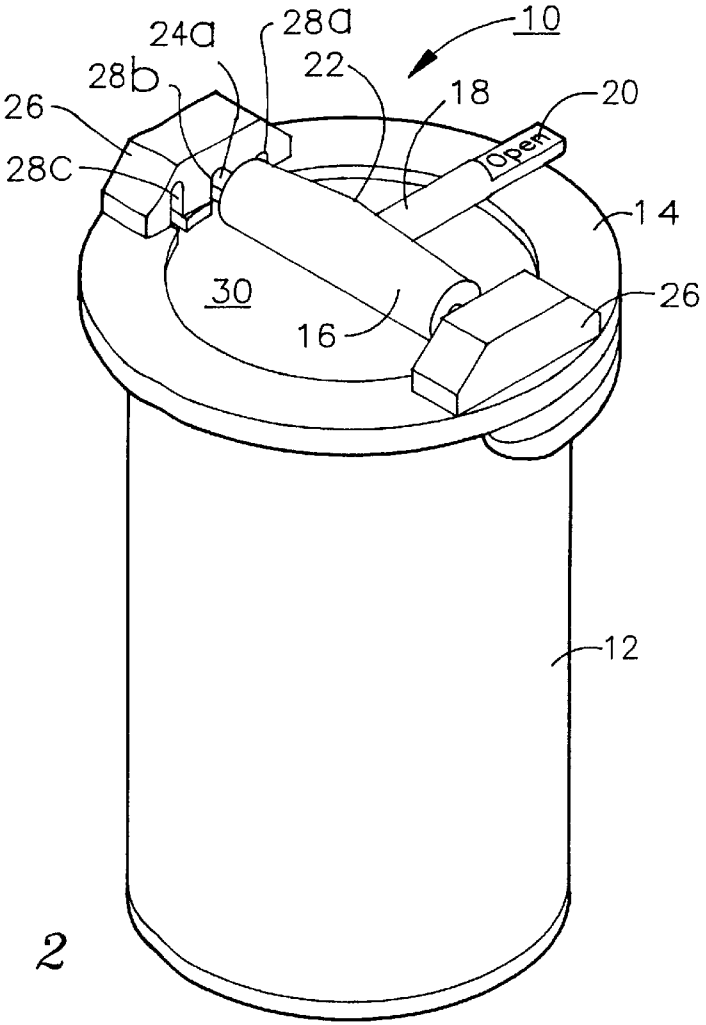
FIG. 2 is a perspective view of the container closure device of the present invention engaged with the top of a container in the open or unsealed position.
Figure 1:
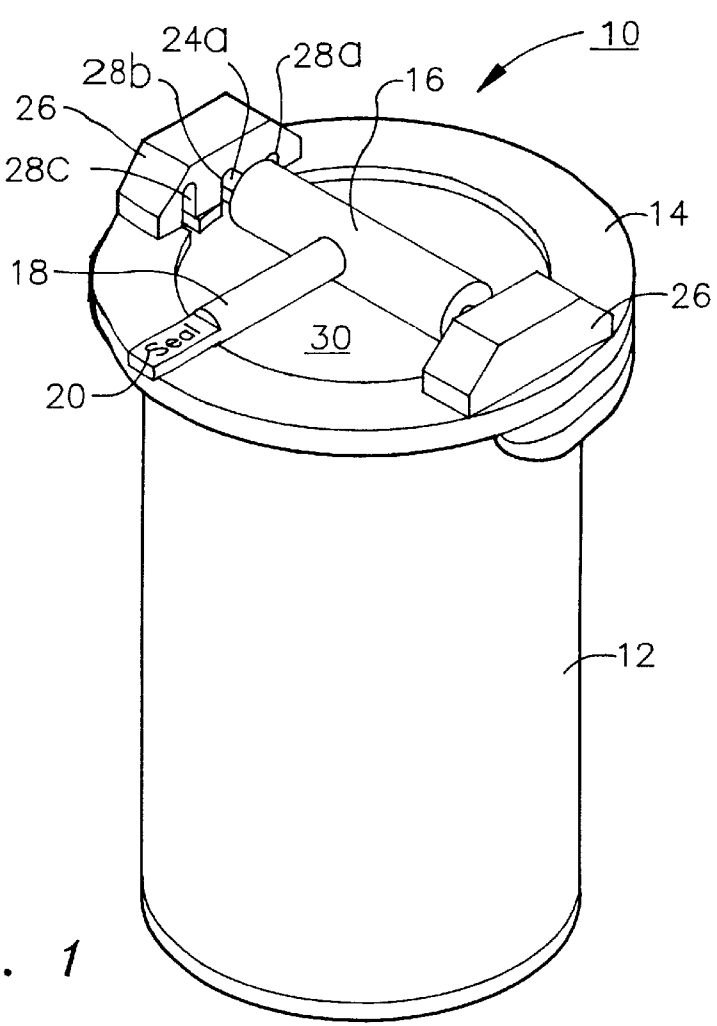
FIG. 1 is a perspective view of the container closure device of the present invention engaged with the top of a container in the closed or sealed position.
Figure 4:
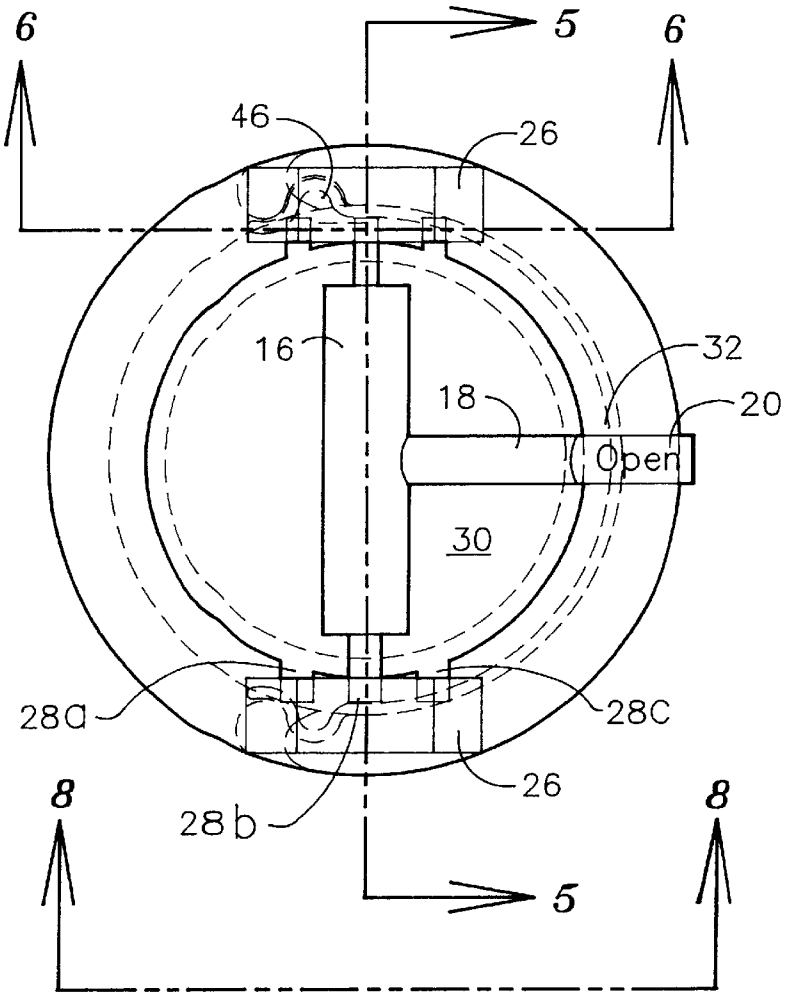
FIG. 4 is a partially phantom top view of the container closure device of the present invention engaged with a container in the open position.
Figure 3:
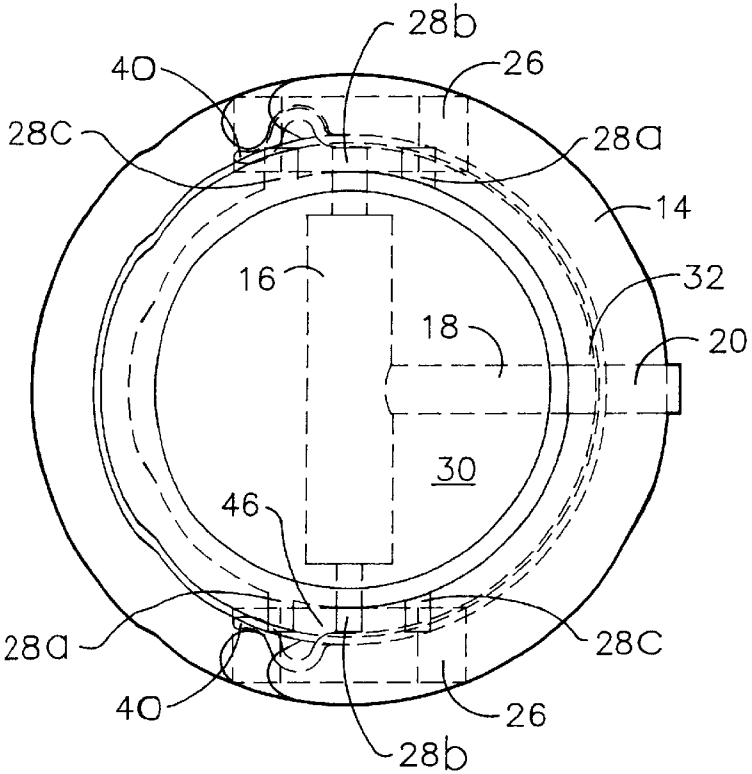
FIG. 3 is partially phantom bottom view of the container closure device of the present invention in the open or unsealed condition.
Figure 8:
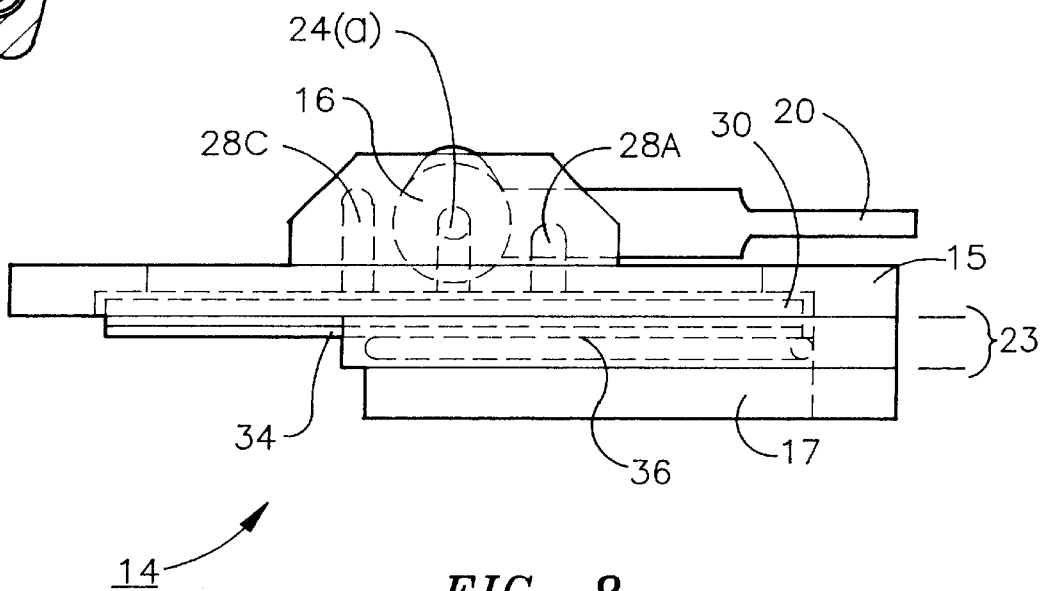
FIG. 8 is a partially phantom view along the line 8—8 of FIG. 4.

Referring now to FIGS. 1 and 2 that depict container closure 10 of the present invention engaged with the top surface of a container 12, container closure device 10 comprises an annular base 14 of a size to cover the periphery of the top of container 12 (shown and described in greater detail below), a cam 16, a cam lever 18 preferably including indicia 20 for indicating whether container closure device 10 is sealed or open, a raised or cam bearing point 22 to provide cam action, a cam shaft 24 extending longitudinally through cam 16 and rotatably engaged with shaft retainers 26 located in opposition atop annular base 14. It should be noted that the opposing ends 24(*a*) and 24(*b*) of shaft 24 as well as mating and opposing shaft engagement apertures 28*a*, 28*b* and 28*c* are preferably of different diameters to permit only a single assembly direction for the purposes described below. Each of shaft retainers 26 preferably includes a plurality of shaft engagement apertures 28*a*, 28*b* and 28*c* of varying depths to permit engagement with container 12 tops having container top ridges of varying heights as described more fully below. Quite clearly, shaft engagement apertures 28*a*, 28*b* and 28*c* of varying depths must be oriented such that opposing ends 24*a* and 24*b* of cam shaft 24 engage shaft engagement apertures 28*a*, 28*b* and 28*c* of equal depth and diameter to provide smooth and even rotation of cam 16, as shown in FIGS. 3 and 4. Thus, shaft engagement apertures 28*a*, 28*b* and 28*c* will be aligned in opposing order on opposing sides of annular base 14 as clearly shown in FIGS. 3 and 4. As will be obvious to the skilled artisan, a single shaft engagement apertures 28 of equal height in each of shaft retainers 26 a pair or an even greater number than three of shaft engagement apertures 28 can be used in the successful practice of the present invention. Annular base 14 is preferably comprised of an upper portion 15 and a lower portion 17 that define a gap 19 that serves to retain spacer 36 therebetween. Within gap 19 and forming a portion thereof is a recessed portion 21. As best shown in FIG. 8, recessed portion 21 is of greater thickness than the combined thickness of annular sealing ring 34 and pressure plate 30 described in detail hereinafter, but of a smaller thickness that the combined thickness of sealing ring 34, pressure plate 30 and spacer 36 also described in greater detail hereinafter.

Figure 5:
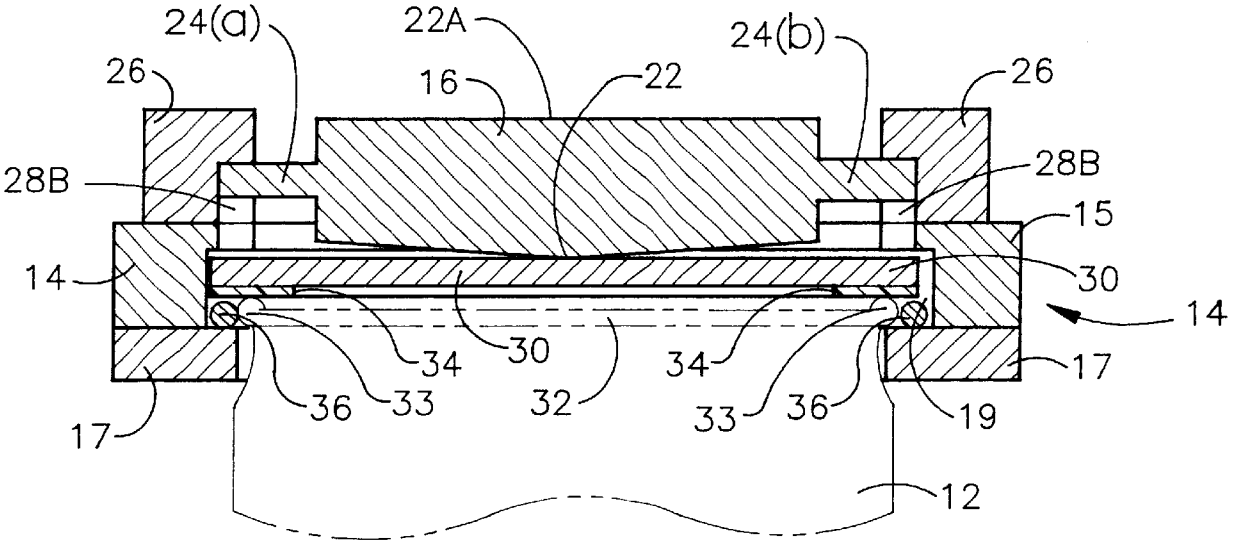
FIG. 5 is a cross-sectional view of the container closure device of the present invention along the line 5—5 of FIG. 4 showing the container closure device of the present invention in the open or unsealed position engaged with the top of a container to be sealed.
Figure 6:
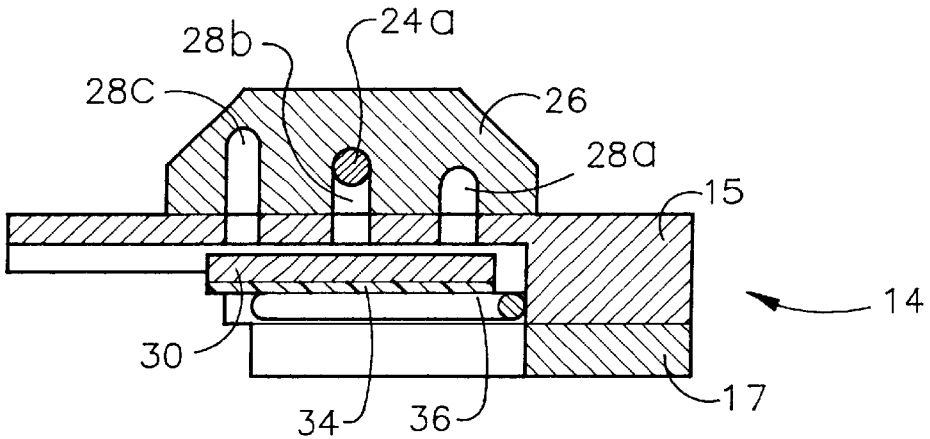
FIG. 6 is a cross-sectional view of the container closure device of the present invention along the line 6—6 of FIG. 4.

As best viewed in FIGS. 5 and 6, container closure device 10 further comprises a pressure plate 30 against which cam 16, and more specifically raised or bearing point 22 of cam 16, bears forcing pressure plate 30 downward in the direction of container top ridge 33 about the periphery of container top 32. This action causes resilient, annular sealing ring 34 to sealingly bear against container top ridge or lip 33 thereby providing a fluid, gas or liquid, proof seal between annular sealing ring 34 and container top ridge 33 which, in the engaged or sealed configuration, is located between annular sealing ring 34 and lower portion 17 of annular base 14 that engages the lower periphery of container top ridge 33 of inserted container 12.

Clearly, to permit insertion of container 12 into gap 19, lower portion 17 is semi-circular, i.e. extending only about one half of the periphery of upper portion 15. More specifically, lower portion 17 is of a size and shape and located so as to provide registration with spacer 36 to permit insertion of container 12 as shown in FIGS. 1, 2 and 5. It is gap 19, described in detail below, that serves to capture the peripheral top ridge 33 when container 12 is inserted into container closure 10 of the present invention. Quite obviously, annular base 14 could easily comprise a monolithic member having gap 19 including recess 21 machined, molded or otherwise formed therein rather than being comprised of two distinct parts 15 and 17. Indeed, elements 15, 17 and even 26 could be molded into or machined from a single piece of material to form a monolithic structure incorporating all of such elements into a single part.

According to a highly preferred embodiment of the present invention, when upper portion 15 and lower portion 17 are separate parts and must be joined together, they are joined by screws or rivets (not shown) extending therebetween.

While the upper surface of pressure plate 30 is depicted herein as being flat, it will be readily apparent to the skilled artisan that this surface, i.e. that opposite the surface which bears annular sealing ring 34, could be slightly bowed to reduce the amount of bow that must be included in cam bearing point 22 on cam 16 as shown at 22*a* in FIG. 5.

Figure 7:
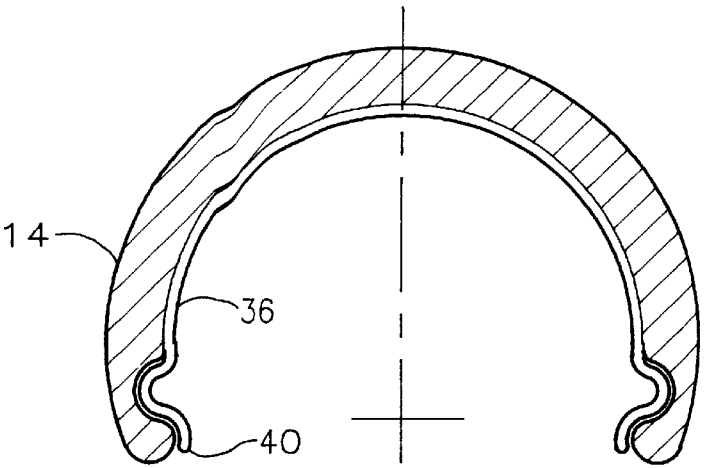
FIG. 7 is a top plan view of certain of the essential elements of the container closure device of the present invention.

The presence of spacer 36 is critical to the successful practice of the present invention. Spacer 36 is a generally horseshoe-shaped, radially compressible and expandable, preferably round spring having rounded and extended and rounded ends 40, best shown in FIGS. 3, 4 and 7. Ends 40 permit easy insertion of container 12 within spacer 36 thereby positioning container ridge 33 for subsequent engagement in gap 19 by lower portion 17 and sealing by the action of cam 16 depressing pressure plate 30 and in turn engaging resilient surface 34 with container ridge 33 as shown in FIG. 5. Engagement of lower portion 17 about container 12 as shown in FIG. 5 causes retention of container 12 in container closure device 10, specifically in gap 19, while cam 16 is rotated from the open to the closed or sealed position causing sealing and engagement of the various members as just described.

The configuration of spacer 36 as a radially compressible spring also permits its removal from container closure device 10 by slight radial compression thereof for purposes of cleaning after use or use on different product containers. Such cleaning is accomplished by radial compression and removal of spacer 36 thereby allowing pressure plate 30 to drop down into the lower portion of gap 19, i.e. out of recess 21 from whence it can easily be removed for cleaning.

Referring now to FIG. 8, it will be apparent to those skilled in the art that the thickness of lower portion 23, i.e. that portion of gap 19 that lies below recess 21, is somewhat greater than the combined thickness of pressure plate 30 and resilient surface 34 but somewhat smaller than the combined thickness of pressure plate 30, resilient surface 34 and spacer 36. Thus when spacer 36 is radially compressed and removed, pressure plate 30 and associated resilient surface 34 can be moved toward lower portion 17, i.e. dropped into lower portion 23 of gap 19, and easily removed for cleaning.

Figure 9:
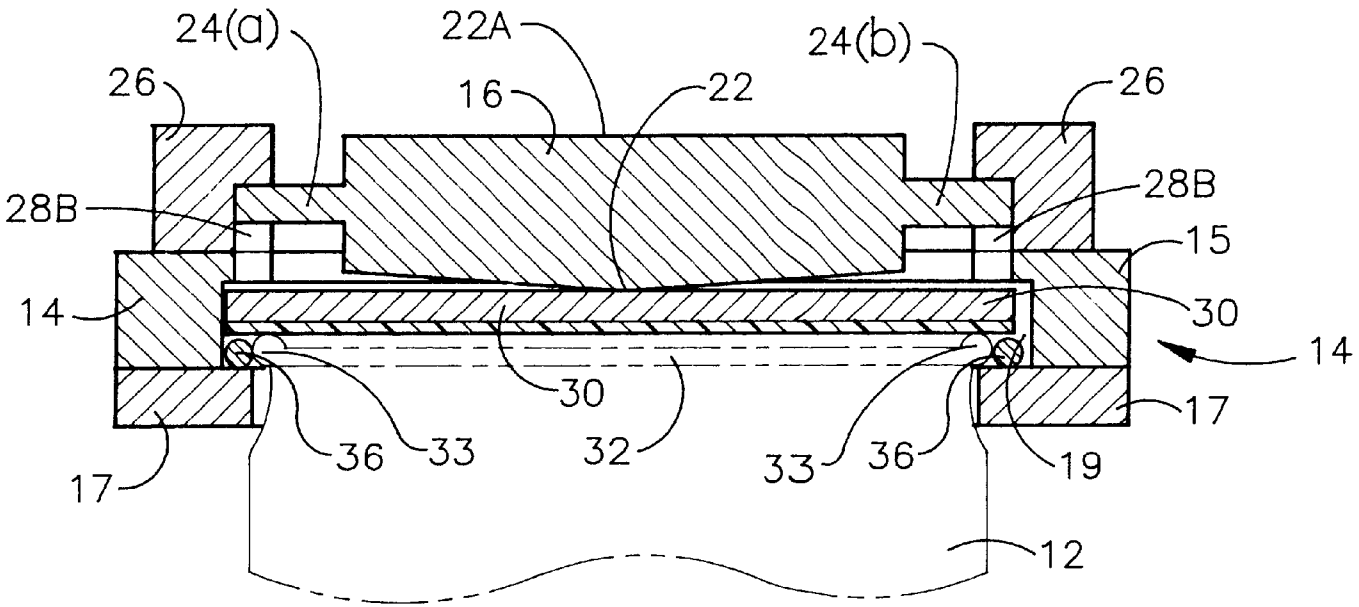
FIG. 9 shows the same view as FIG. 5, but with an alternative configuration for the pliant layer.

While annular sealing ring 34 is depicted in the Figures and described herein as an "annular ring", it will be readily apparent to the skilled artisan that the "ring" configuration could easily and effectively be replaced by the use of a solid layer or surface of resilient material that covered all or substantially all of the lower surface of pressure plate 30, so long as adequate contact between container top ridge 33 and the resilient material of "annular ring" 34 is provided to produce the required fluid resistant seal about top ridge 33. Such an embodiment is depicted in FIG. 9.

Container closure device 10 may, of course, be manufactured from a wide variety of materials so long as each member is manufactured from a material that provides adequate properties to meet the performance requirements of that particular element. For example, annular base 14 and associated shaft retainers 26 can be fabricated from metal or a suitably stiff polymeric material, although aluminum or steel is specifically preferred depending upon the particular use to which container closure device 10 will be put. Similarly, while cam 16 and all of its various elements, shaft 24, etc. can be fabricated from a variety of polymeric and metallic materials, it is preferred that they be fabricated from aluminum or steel for durability.

Spacer 36 is preferably fabricated from spring steel, although, again, a suitable polymeric material that provides the required radial expandability and compressibility could be substituted therefor.

In use, container closure device 10 is utilized by sliding ridge 33 of a container 12 into gap 19 while cam 16 is in the open position and then once ridge 33 is properly engaged within gap 19 and with spacer 36, as described hereinabove, rotating lever 18 to the sealed position, rotation through about 180°, causing cam bearing point 22 to bear on the top surface of pressure plate 30 thereby forcing pressure plate 30 downward and resulting in resilient annular ring 34 tightly engaging ridge 33 thereby sealing the container.

While container closure 10 has been described herein largely in connection with soft drink, beer or other similar containers, it should be noted, that container closure device 10 is similarly useful, in an appropriate size, for use on, for example, paint containers, food containers and other similar containers that need to be tightly sealed against the infiltration or exfiltration of a fluid such as a gas or liquid for extended periods of time.

While cam 16 and its associated bearing point(s) 22, (22*a*) and cam lever 18 can be oriented to permit sealing of container closure device 10 in either direction of movement of cam lever 18, it is specifically preferred that these various members be oriented such that movement of cam lever 18 from the "open" to the "sealed" condition be such that such movement tends to push container closure device 10 toward tighter engagement with container 12 as shown in the various Figures attached hereto.

As described herein, container closure device 10 has been described as being circular or round. It will be obvious to the skilled artisan that the principles and designs described herein could be easily transferred to a container closure device useful for sealing square, rectangular, oval or other shaped containers having an appropriate top ridge with which engagement of a resilient sealing surface can be achieved. The fabrication of such a closure device would involve largely the alteration of the shape of the various members to obtain such a device.

As the invention has been described, it will be apparent to those skilled in the art that the same may be varied in many ways without departing from the spirit and scope of the invention. Any and all such modifications are intended to be included within the scope of the appended claims.

What is claimed is:

1. A container closure device comprising:

A) a base comprising:
  i) an annular upper portion; and
  ii) a lower portion defining a gap between said annular upper portion and said lower portion;
    said gap being divided into a recess extending into said annular upper portion and a lower gap portion;

B) a pressure plate contained in said gap and having:
  i) an upper surface; and
  ii) a lower surface bearing a pliant sealing surface;

C) a cam proximate the upper surface and comprising:
  i) an eccentric cam body;
  ii) a longitudinal cam shaft having opposing ends; and
  iii) a cam lever having an associated eccentric cam body and capable of rotating the eccentric cam body to cause different portions of the eccentric cam body to contact the pressure plate;

D) a mechanism for engaging said opposing ends and allowing rotational movement of the cam lever and can body; and E) a radially compressible spacer having opposed spacer ends in said gap between said pliant sealing surface and said lower portion to retain said pressure plate and said pliant sealing surface in said gap but at a distance from said lower portion;
    said lower gap portion being; a) of a thickness smaller than the sum of the thicknesses of said pressure plate, said pliant sealing surface and said spacer; and b) of a thickness greater than the sum of the thicknesses of said pressure plate and said resilient surface; and said radially compressible spacer being capable of removal from said gap by radial compression thereof by the application of pressure to said spacer opposed ends.

2. The container closure device of claim 1 wherein said spacer comprises a generally horseshoe-shaped and radially compressible and expandable flat or round spring and said lower portion is also generally horseshoe-shaped.

3. The container closure device of claim 1 wherein said pliant sealing surface comprises an annular sealing surface of a size to engage the top ridge of an inserted container.

4. The container closure device of claim 1 wherein said pliant sealing surface comprises a layer of sealing material covering all or substantially all of said lower surface.

5. The container closure device of claim 1 further including indicia on said cam lever for identifying whether the can closure device is in the open or sealed condition.

6. The container closure device of claim 1 wherein said mechanism for engaging said opposing ends comprises a pair of opposed cam shaft retainers located on said upper portion each including at least one cam shaft engagement aperture.

7. The container closure device of claim 6 wherein said opposed cam shaft retainers each contains a plurality of cam shaft engagement apertures of varying heights.

8. The container closure device of claim 1 having a generally circular configuration and wherein said lower portion and said spacer are generally horseshoe-shaped.

9. The container closure device of claim 1 wherein said opposing ends are different diameters and said mechanism for engaging said opposed ends include apertures of different diameters matching those of said opposed ends and into which said opposed ends are inserted to allow assembly of said container closure device in only one predetermined orientation.

10. A container closure device comprising:

A) a base comprising:
  i) an circular upper portion; and
  ii) a generally horseshoe-shaped lower portion defining a gap between said annular upper portion and said lower portion;
    said gap being divided into a recess extending into said annular upper portion and a lower gap portion;

B) a pressure plate contained in said gap and having:
  i) an upper surface; and
  ii) a lower surface bearing an annular pliant sealing surface;

C) a cam proximate the upper surface and comprising:
  i) an eccentric cam body having a bearing portion;
  ii) a longitudinal cam shaft having opposing ends of different diameters; and
  iii) a cam control arm capable of rotating the cam through an angle of about 180° to cause said bearing portion to contact the pressure plate;

D) a pair of opposed cam shaft retainers located on said upper portion each including at least one cam shaft engagement aperture for engaging said opposing ends and allowing rotational movement of the cam; and E) a generally horseshoe-shaped, radially compressible spacer having opposed spacer ends in said gap between said pliant sealing surface and said lower portion to retain said pressure plate and said resilient surface in said gap but at a distance from said lower portion;
    said lower gap portion being; a) of a thickness smaller than the sum of the thicknesses of said pressure plate, said resilient surface and said spacer; and b) of a thickness greater than the sum of the thicknesses of said pressure plate and said resilient surface; and said radially compressible spacer being capable of removal from said gap by radial compression thereof by the application of pressure to said spacer opposed ends.

* * * * *